US005627150A

United States Patent [19]

Peterson et al.

[11] Patent Number: 5,627,150

[45] Date of Patent: May 6, 1997

[54] PAPERBOARD CONTAINER FOR SOLID BLOCK DETERGENTS

[75] Inventors: Jeff W. Peterson, Hudson, Wis.; Tina O. Outlaw, Inver Grove Heights; Debra A. Crea, Stillwater, both of Minn.

[73] Assignee: Ecolab Inc., St. Paul, Minn.

[21] Appl. No.: 543,289

[22] Filed: Oct. 16, 1995

[51] Int. Cl.[6] ..... C11D 17/00; B65D 90/04; B65D 43/04; B65D 21/00

[52] U.S. Cl. ..... 510/439; 510/441; 220/402; 220/403; 220/410; 220/771; 206/515

[58] Field of Search ..... 252/93, 90; 220/402, 220/403, 410; 510/439, 441; 206/515

[56] References Cited

U.S. PATENT DOCUMENTS

| | | | |
|---|---|---|---|
| Re. 32,763 | 10/1988 | Fernholtz et al. | 252/90 |
| 2,181,569 | 11/1939 | Mackenzie | 229/14 |
| 2,338,604 | 1/1944 | Silveyra | 229/14 |
| 2,352,503 | 6/1944 | Walton | 229/14 |
| 2,554,722 | 5/1951 | Waters | 154/83 |
| 2,744,655 | 5/1956 | Vnuk | 220/63 |
| 3,183,800 | 5/1965 | Farrell et al. | 93/36 |
| 3,301,391 | 1/1967 | Guyer | 206/56 |
| 3,399,820 | 9/1968 | Foster et al. | 229/37 |
| 3,528,921 | 9/1970 | Gray | 252/99 |
| 3,580,466 | 5/1971 | Thelen et al. | 229/14 |
| 3,779,447 | 12/1973 | Bemiss | 229/14 B |
| 3,892,905 | 7/1975 | Albert | 428/220 |
| 3,895,713 | 7/1975 | Bunnell | 206/427 |
| 3,921,892 | 11/1975 | Macie | 229/17 B |
| 3,972,467 | 8/1976 | Whillock et al. | 229/14 BL |
| 4,234,442 | 11/1980 | Cornelissens | 252/90 |
| 4,397,406 | 8/1983 | Croley | 222/105 |
| 4,426,362 | 1/1984 | Copeland et al. | 422/263 |
| 4,569,780 | 2/1986 | Fernholz et al. | 252/90 |
| 4,569,781 | 2/1986 | Fernholz et al. | 252/92 |
| 4,635,814 | 1/1987 | Jones | 220/403 |
| 4,692,494 | 9/1987 | Sonenstein | 525/57 |
| 4,698,246 | 10/1987 | Gibbons et al. | 428/35 |
| 4,753,832 | 6/1988 | Brown et al. | 428/35 |
| 4,765,916 | 8/1988 | Ogar, Jr. et al. | 252/8.9 |
| 4,774,014 | 9/1988 | Kuenzel et al. | 252/90 |
| 4,805,799 | 2/1989 | Robbins, III | 220/403 |
| 4,815,631 | 3/1989 | Eeg et al. | 220/403 |
| 4,834,261 | 5/1989 | Brdlik | 220/404 |
| 4,890,772 | 1/1990 | Heuberger et al. | 222/156 |
| 4,953,739 | 9/1990 | Wooge et al. | 220/93 |
| 5,125,565 | 6/1992 | Rogers | 229/115 |
| 5,316,688 | 5/1994 | Gladfelter et al. | 252/90 |
| 5,377,876 | 1/1995 | Smernoff | 222/105 |
| 5,429,263 | 7/1995 | Haubenwallner | 220/404 |
| 5,474,184 | 12/1995 | Mandler et al. | 206/519 |

FOREIGN PATENT DOCUMENTS

| | | |
|---|---|---|
| 0462624 | 12/1991 | European Pat. Off. . |
| 1171127 | 11/1969 | United Kingdom . |

*Primary Examiner*—Douglas J. McGinty
*Assistant Examiner*—Lorna M. Douyon
*Attorney, Agent, or Firm*—Merchant, Gould, Smith, Edell, Welter & Schmidt, P.A.

[57] ABSTRACT

Disclosed is a container 10, 25 for dispensing of detergents and other solid chemicals, and a method for manufacturing the container 10, 25. The container 10, 25 has a paperboard housing 11, 26 which contains a plastic bladder 21, 27. The exposed surface of the solid chemical is covered by a cap 12, 32. A handle 16, 37 is provided. The container 10, 25 is suitable for use in a dispensing device 40.

23 Claims, 5 Drawing Sheets

FIG. 1
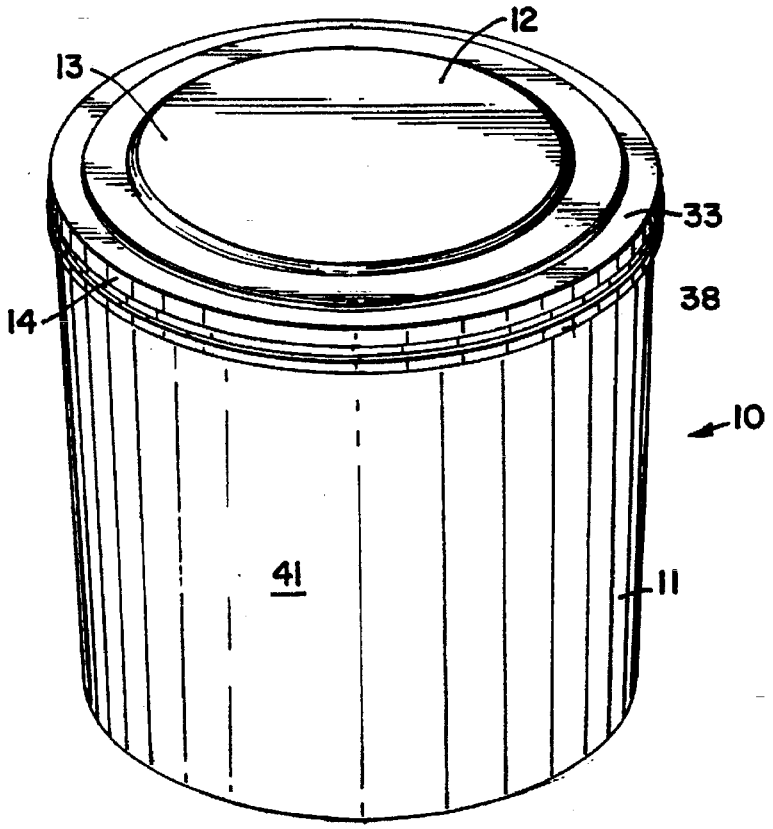
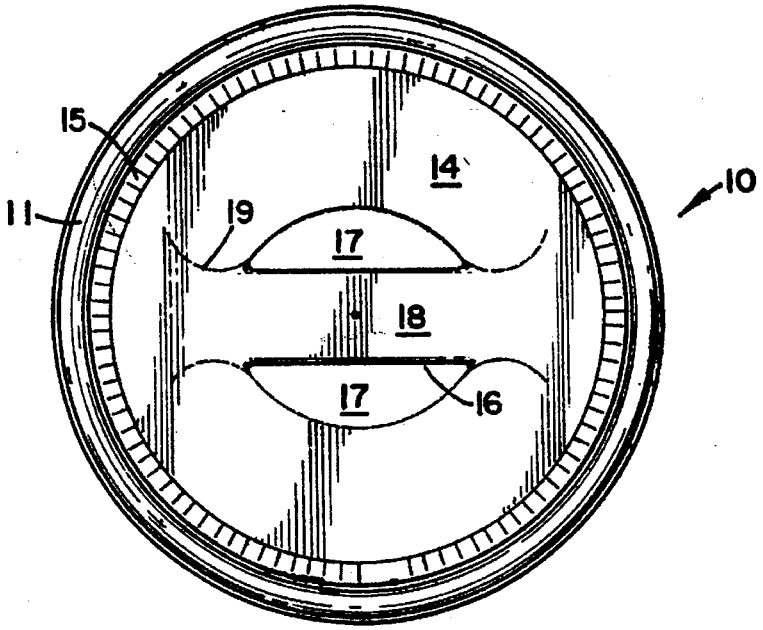
FIG. 2

FIG.4
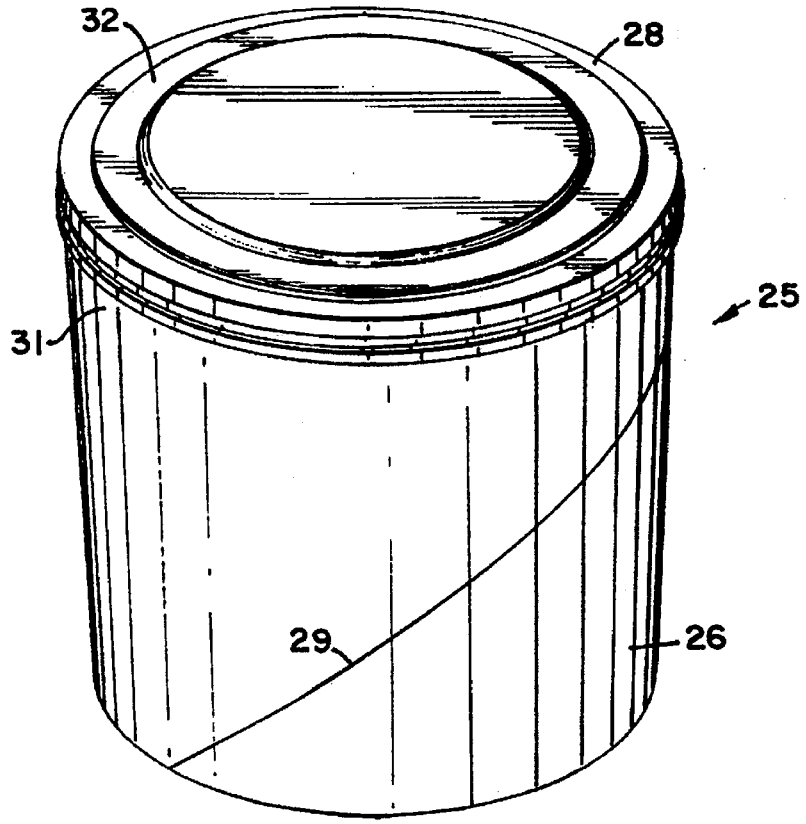
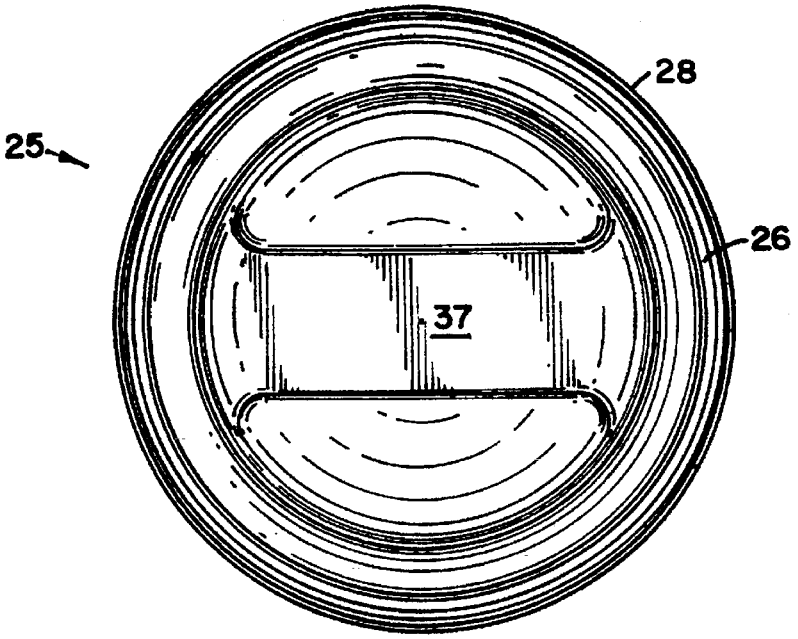
FIG.5

PAPERBOARD CONTAINER FOR SOLID BLOCK DETERGENTS

FIELD OF THE INVENTION

This invention relates generally to paperboard containers, and more particularly to a paperboard container which is insertable in a dispensing apparatus for a solid detergent.

BACKGROUND OF THE INVENTION

The utilization of automatic dispensers to dispense chemicals used in cleaning processes is well known in the art. Cleaning compositions include compounds such as detergents, rinse aids, softeners, bleaches and the like employed to clean fabrics, dishes and hard surfaces.

The cleaning composition may be a solid detergent in several different forms, including powder, flakes or granular detergent, and pre-shaped detergent briquettes. Another form of solid detergent is the "cast" or block form, comprising detergent that is cast within a mold or a container. Dispensing systems for these solids are known in the art. See, for example, U.S. Pat. No. 4,426,362, issued to Copeland et al. and commonly owned U.S. Pat. Nos. 4,569,781 and 4,569,780 issued to Fernholz et al. The solid detergent is dispensed by spraying a solvent onto the detergent block within the container, thereby dissolving the exposed surface of the detergent to form a concentrated working solution. The concentrated working solution falls into a reservoir or is directed by a conduit to the wash tank of a washing apparatus. When a chemical compound within the container is completely utilized, the exhausted container is discarded, and a fully charged container is placed in the dispenser.

Solid chemicals used in cleaning processes are preferably cast in a sturdy container which can act as a mold, a shipping and storage container, and a dispenser housing. The container may either be retained within the dispenser as the chemical is being used, or the chemical may be removed from the container and placed into the dispenser. However, hazardous chemicals used in cleaning processes such as highly alkaline detergents are preferably packaged such that they can be dispensed without coming into physical contact with the human body.

The advent of high performance products, stimulated in part by increased aesthetic and sanitary standards and a demand for shorter wash times, has generally been characterized by the development of more complex detergent compositions which are more hazardous to the user, less stable, and more difficult to dissolve in a satisfactorily uniform manner. Chemicals used in high performance products, particularly for hard surface cleaning (e.g. ware washing), include alkali metal hydroxides (e.g. sodium hydroxide), phosphates, silicates, chlorine-containing compounds, defoamers and organic polyelectrolyte polymers.

Utilization of solid cleaning compositions has several advantages over the use of pre-mixed liquid cleaning compositions. These advantages include the fact that the solid detergent is easier and cheaper to ship due to its greatly-reduced weight; the solid detergent requires less storage space; and the solid detergent improves the safety of the work environment by reducing possible splashing of hazardous chemicals. Overall, the solid detergent is more convenient for the user, and it permits easy transfer from a container to a dispenser, involving no pouring, spilling or leftover product.

In the past, the containers for the solid detergents have been made entirely of a molded plastic material such as polyethylene or polypropylene. The containers are filled with detergent, stored, shipped to the point of use, and placed into a dispenser. The containers are subjected to extreme conditions such as high moisture, extremely high and low temperatures, and corrosive chemicals. The plastic containers are used only a single time, and then are often discarded to a landfill. These plastic containers sometimes are recycled, but they typically cannot be stacked or collapsed to a compact or flat form.

SUMMARY OF THE INVENTION

The present invention is a detergent-containing article of commerce, comprising a bladder made of a plastic material; a solid chemical within the bladder such as a detergent; a paperboard housing surrounding the bladder; and a cap which is removably attached to the housing. In the preferred embodiment, the exposed surface of the detergent has a water-soluble coating. Additionally, one end of the container has a handle. The bladder and housing are attached such that they can be separated from each other after the container has been used.

Another aspect of the invention is a method for manufacturing the container. This method comprises the steps of: attaching a bladder within a paperboard housing, filling the bladder with detergent or other solid chemical, applying a water-soluble coating to the eroding surface of the detergent, and affixing a cap to the housing so as to cover the eroding surface of the detergent.

A particular advantage of the present invention is that the container can be disposed of in an environmentally sound manner. The container of the present invention has less plastic than prior containers employed for similar purposes. Portions of the package are recyclable. The container's bladder can be made from recycled polymers such as polyethylene, or water dispersible polymers, such as polyvinyl alcohol or ethylene acrylic acid. The paperboard components of the package are separable from the recyclable portions of the package so that these two components can be sent to different destinations after the container has been used. Furthermore, the package can be crushed into a compact configuration after use, thereby reducing space requirements for the user.

Another advantage of the container is that the container can be fabricated, filled with the detergent, stored in a warehouse, and shipped to the intended destination in a simple and efficient manner. The invention reduces storage and handling requirements, because the housing walls, bottom disks and top closures can be shipped flat. The bladders can be nested. As a result, a minimal amount of storage space is necessary. This results in cost savings for the manufacturer, and reduces labor and space requirements. The finished containers are stackable and weigh less than conventional containers.

Yet another advantage of the present invention is that the container is able to be filled with highly corrosive detergent products. The container maintains its structural integrity throughout the storage, shipping and dispensing steps, and there is no leakage which could expose the user to potentially hazardous chemicals. Even if the outer paperboard housing were to tear or be damaged, the detergent product would still be contained within an interior bladder. Also, the detergent does not come in contact with the user because of the container's design and because of the presence of a water soluble coating on the detergent's exposed surface.

Yet another advantage of the present invention is that it can be utilized with conventional dispensing apparatus which have in the past utilized plastic containers. Thus, no retrofitting or replacement of the relatively expensive dispensing equipment is necessary in order to use the containers of the present invention.

These features, along with other advantages, will become subsequently apparent, based on the details of construction and operation as more fully described hereinafter, reference being made to the accompanying drawings, wherein like numerals refer to like parts throughout.

BRIEF DESCRIPTION OF THE DRAWINGS

FIG. 1 is a perspective view of the first embodiment of the container.

FIG. 2 is a bottom plan view of the container illustrated in FIG. 1.

FIG. 4 is a perspective view of the second embodiment of the container.

FIG. 5 is a bottom plan view of the container illustrated in FIG. 4.

DETAILED DESCRIPTION OF THE PREFERRED EMBODIMENTS

Figure 7:
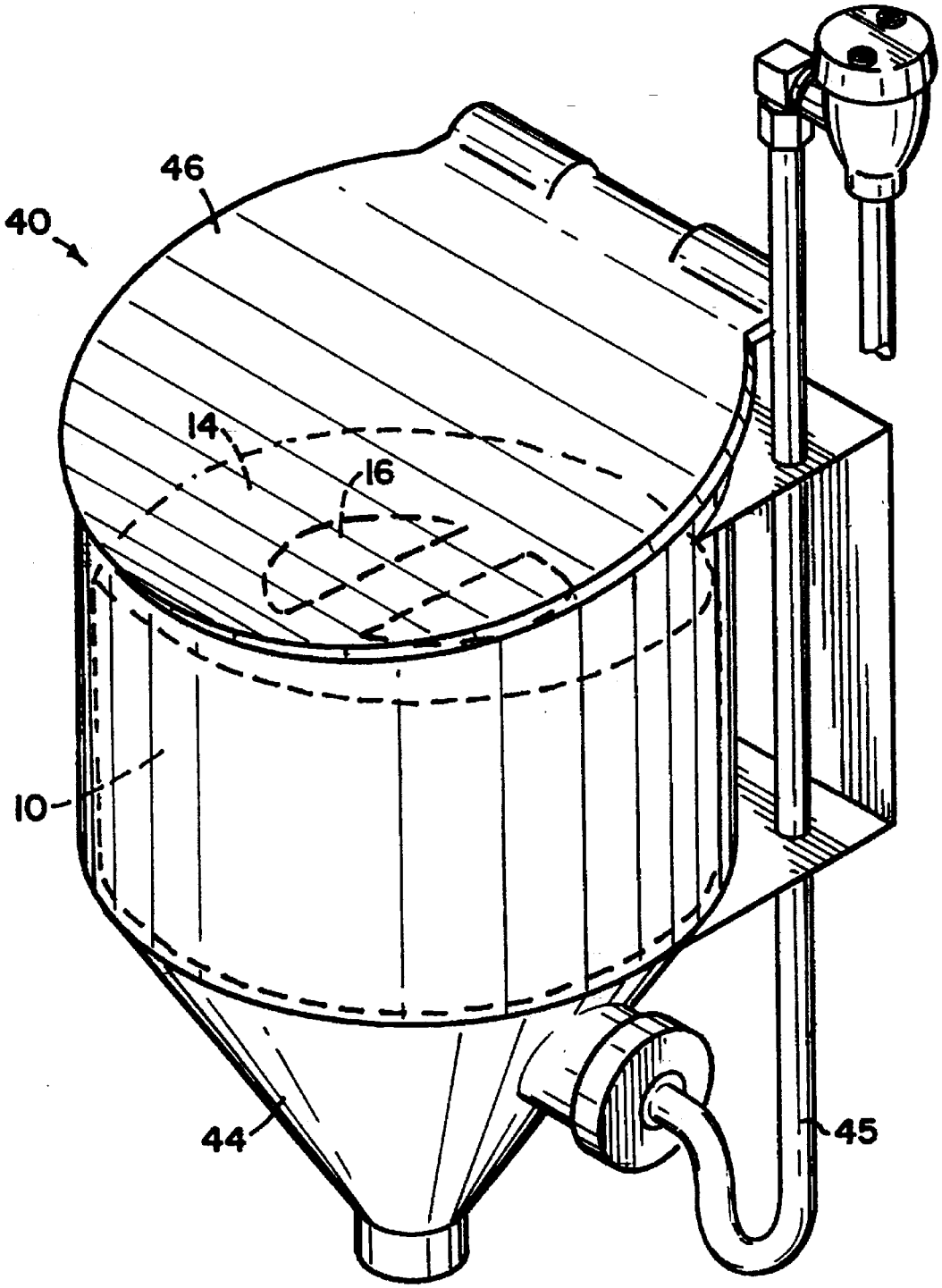
FIG. 7 is a perspective view of the container illustrated in the FIGS. 1–3, positioned within a dispensing apparatus.

A first embodiment of the container 10 for solid chemicals is illustrated in FIGS. 1–3 and 7. The container 10 serves as a mold for the solid detergent, a shipping and storage container, and a housing for the detergent while it is being dispensed. The container 10, as positioned within a dispensing device 40, is illustrated in FIG. 7. The container 10 is inverted and placed in a detergent dispenser reservoir 44. Water from a conduit 45 enters the dispensing device 40, and is directed toward spray means (such as a spray nozzle) within the dispenser 40. An upwardly-directed water spray dissolves the detergent from the container 10 in an amount as needed. The dissolving apparatus 40 need not be physically removed from the washing machine. Indeed, it is a common practice to mount dissolving/dispensing devices 40 directly above—or on the side wall of—the wash tank of the cleaning machine.

The container 10 has a housing 11 which has a cylindrical side wall 41 and bottom end member or disk 14. The side wall 41 and disk 14 of the housing 11 are made of a paperboard material. In the preferred embodiment, a plastic film or coating (not shown) is applied to both the outer and inner surfaces of the housing 11. Alternatively, the film could be applied to either the inside surface or the outside surface. The coating is preferably made of a polyethylene material, and it is applied to the paperboard with either a laminating or cascading process. The film provides additional stability and durability to the container 10 by protecting the container 10 from excessive moisture.

The container 10 has a cap 12 on the top end 38 of the housing 11. The cap 12 has a circular shape, with an optional raised center portion 13 for a label or graphics, surrounded by one or more annular ledge portions 33. The raised portion 13 and ledge portion(s) 33 facilitate stacking of several containers 10. The cap 12 has an annular lip 14 which is slightly larger than the size of the housing 11, so that the cap 12 can be snap-fit into place on the housing 11. Instead of a snap-fit cap, the cap 12 could be removably attached to the housing 11 in other ways, such as by utilizing a tearaway strip (not shown).

FIG. 2 illustrates a bottom view of the housing 11, i.e., the end opposite the cap 12. The end wall or disk 14 is preferably adhered to the side wall 41 of the housing 11 by a suitable adhesive. Suitable adhesives include poly (vinyl alcohol-acetate) blends, dextrin, animal glue, polyethylene, and hot melts. The paperboard of the side wall 41 is folded over and crimped, so as to form a pleated border 15 around the edge of the disk 14. In this manner, the outer periphery of the disk 14 is sealed to the inner periphery of the housing 11. The disk 14 is preferably made of paperboard, and the disk 14 may or may not have a plastic coating on one or both sides. Preferably, the paperboard material for the disk 14 contains a wet strength additive. This additive prevents degradation of the container 10 due to exposure to water or chemicals.

Figure 3:
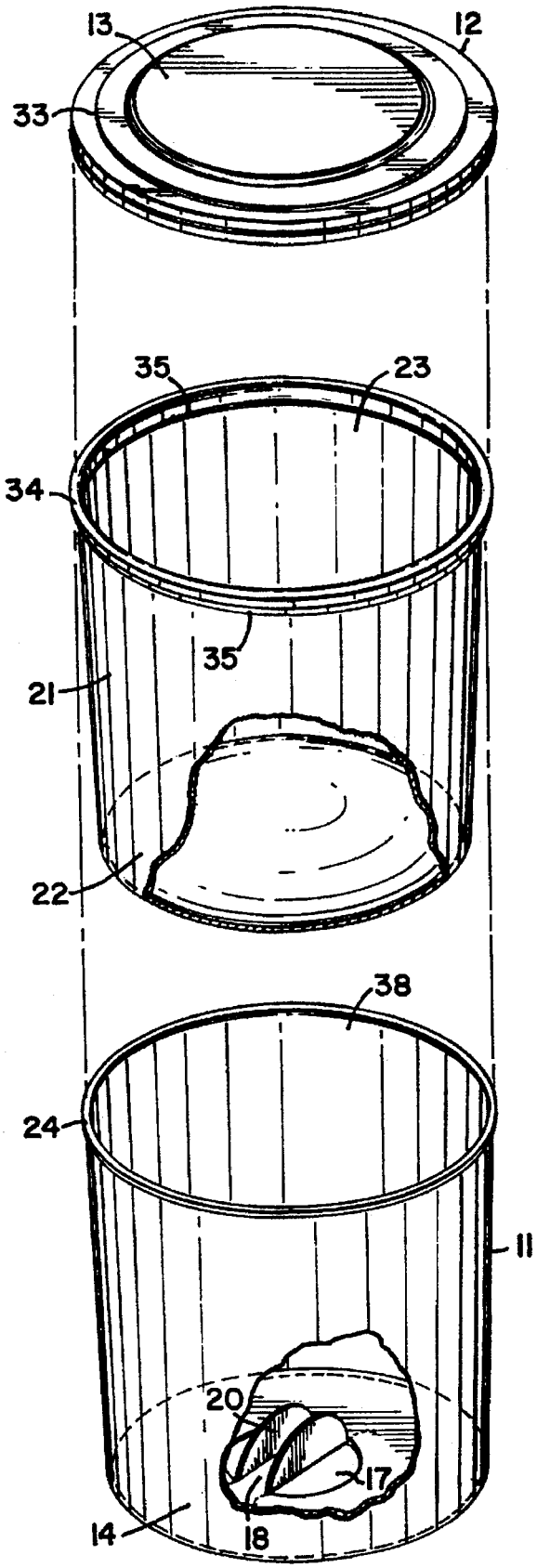
FIG. 3 is an exploded view of the container illustrated in FIGS. 1–2.

A handle 16 may be formed in the disk 14. Preferably, a pair of curved score lines 19 in the disk 14 enable the user to tear away and fold a pair of flaps 20 inwardly. This forms a pair of semi-circular finger holes 17 separated by a bridge 18. As shown in FIG. 3, the flaps 20 extend into the interior of the housing 11. The holes 17 allow the user's thumb and finger to be inserted in the opposite hollows of the handle 16 to permit ease of holding and removal of the container 10 from the dispenser housing 40.

As shown in the exploded view of FIG. 3, there is a bladder or liner 21 which is insertable within the housing 11. The bladder 21 has a cylindrical side wall, a first closed end 22, and an opposite open end 23. The bladder 21 has a lip 34 which fits over the rim 24 of the housing 11. Preferably, the lip 23 is attached to the rim 24 with a ring of hot-melt adhesive. Alternatively, a heat-sealing process could be used to adhere the bladder 21 to the housing 11.

The liner 21 is made of a lightweight plastic material, preferably low-density, medium-density, or high-density polyethylene or polypropylene. Other resins such as PET (polyethylene terephthalate) or polyvinyl chloride could also be used. The bladder 21 can be manufactured using a thermoforming, injection-molding or blow-molding process. The liner 21 is made of either a semi-rigid or flexible material.

In the preferred embodiment, the liner's side wall has a ring 35 proximate its upper end. The upper portion of the liner's side wall (above the ring 35) has a slightly larger diameter than the remainder of the liner's side wall, thus forming the ledge or ring 35. The rings 35 facilitate the stacking or nesting of many liners 21 before the liners 21 are filled with the detergent during the manufacturing process.

The detergent composition is normally formed by mixing and heating the composition in an aqueous solution, thickening the solution and preferably also cooling it, pouring the solution into the bladder 21 which serves as a mold, and allowing the mixture to solidify. The cast detergent composition is preferably left in the bladder 21 during the dispensing process. Alternatively, the detergent block could be popped out of the bladder 21 onto a screen in the dispensing device 40. The detergent may have a wide variety of applications, such as rinse aids, softeners, bleaches, and cleaning compositions for cleaning fabrics, dishes and/or hard surfaces. An eroding surface of the solid detergent is proximate the open end 23 of the bladder 21. As used in the claims, the term "eroding surface" is the detergent surface's position when the article 10, 25 is full. It is to be understood that the position of the eroding surface will change as the detergent level recedes.

In the preferred embodiment, a water-soluble coating is poured or sprayed onto the exposed surface of the detergent. This coating or membrane seal increases the stability of the detergent and provides safety for the user by preventing contact with the highly alkaline, caustic detergent. The barrier coating substantially covers the surface of the detergent mass and prevents the absorption of environmental water from the atmosphere into the surface of the detergent mass. That is, the water soluble covering protects the hands of the person who handles the container 10. The water-soluble film may be of polyvinylalcohol, or of the type described in U.S. Pat. No. 5,316,688 to Gladfelter et al.

The coating comprises a continuous layer covering substantially the entire exposed face of the detergent mass. The coating preferably has a thickness of about 0.1 to 12 millimeters, most preferably about 0.5 to 3 millimeters. The coating should be chemically stable with respect to the chemical constituents of the detergent mass. The coating can be introduced onto the detergent mass using any conventional coating technique such as coextrusion, spray coating, curtain coating, immersion, surface molding and others. Combinations of coating processes can also be used to ensure that a complete coating is formed. For example, an initial coating can be coextruded surrounding an extruded detergent mass core. Such a process would leave open, uncoated ends on the detergent mass. Such an article can be further coated using spraying, curtain coating, etc. to seal the ends.

Coating compositions can comprise materials that are applied in the form of liquids. Such liquids can be room temperature solids that can be applied in the form of a heated melt or in the form of a solvent-based solution or dispersion. Such dispersions could be made using water as a liquid base or using other solvents such as ethanol, methanol, propanol, petroleum ether, benzene toluene, etc. Preferably solvent-based materials are applied in the form of aqueous dispersions for reasons of cost and safety. Preferred dispersion materials can be sprayed or otherwise coated on the detergent mass, leaving a coating after the aqueous or other vehicle has evaporated. Such dispersions preferably comprise 10–80 wt-% solids, the balance being water stabilizers and other functional ingredients. The dispersion should have a viscosity that permits ease of coating but should maintain sufficient solids to rapidly coat the detergent mass. Suitable dispersions for use in the coatings of the composition include poly(ethylene-co-vinylacetate), poly(ethylene-co-acrylic acid), poly(ethylene-co-methylacrylate), acrylic homopolymers such as polyacrylic acid, polymethacrylic acid, polymethylmethacrylate, styrene-butadiene-styrene copolymers, styrene-acrylic copolymers.

The coatings can also be applied in the form of an aqueous solution of materials. Soluble materials can include soluble polymeric materials such as soluble surfactants, soluble cellulosic materials, soluble salts, etc. Examples of such materials include polyethylene glycol (polyethylene oxide), polyethylene oxide, polypropylene oxide, block copolymers, polyacrylic acid, etc.

The water-soluble coating could also be applied in the form of a melt material. Such materials are commonly substantially organic compositions having a melting point greater than about 30° C., preferably about 35°–55° C., have a melt viscosity that can obtain a continuous, uniform coating at about 30°–60° C., can and are stable to the presence of the alkaline materials in the detergent mass. Among the useful coatings include waxy materials. Such waxes include low molecular weight (e.g. 1000–6000 molecular weight) polyethylenes having a softening point of about 66° to about 150° C., petroleum waxes such as paraffin wax having a melting point of from about 60° to about 100° C., microcrystalline wax having a melting point from about 60° to about 100° C., and synthetic waxes made by polymerizing carbon monoxide and hydrogen such as Fisher-Tropsch wax.

Further, hydrogenated animal or vegetable fats or oils can also be used for the water-soluble coating if they possess the appropriate melting points and melt viscosity. Such oils include lard, hydrogenated soy bean oil, hydrogenated cotton seed oil, and hydrogenated castor oil. Further, hydrogenated fatty acids obtained from the oils discussed above can also be used as coating materials. Further derivatives of the fatty acids set forth above can be used as coating materials. Preferred fatty acid derivatives include fatty acid amides made by reacting the fatty acid with nitrogen bases. Preferred nitrogen bases include ammonia and an amine. Preferred amines include methyl amine, dimethyl amine, ethyl amine diethyl amine, monoethanol amine, diethanol amine, and other reactive amines providing at least one active hydrogen on the amine nitrogen for reaction with the fatty acid carboxylic acid group. Preferred coating materials for use in a melt coating composition of the invention include hydrogenated and non-hydrogenated coco fatty acid, hydrogenated and non-hydrogenated stearic acid, hydrogenated and non-hydrogenated stearic acid monoethanol amide, hydrogenated and non-hydrogenated stearic acid diethanol amide, paraffin wax, polyethylene glycol having a molecular weight ranging from about 1000 to 10,000, pluronic block copolymers comprising at least one polyethylene oxide block and at least one polypropylene oxide block having molecular weights of about 1000 to 10,000.

The coating composition formed on the detergent mass can comprise a single layer comprising the organic material. Further, the coating can comprise a single layer of organic material with inorganic materials used as diluents or as materials that can promote the solubility or other removal of the coating. Such organic coatings can contain as an inorganic component, sodium chloride, sodium sulfate, sodium carbonate, sodium acetate, sodium metasilicate, sodium phosphate, trisodium phosphate, trisodium polyphosphate, sodium acrylic polymers and others. The organic coatings that optionally can contain some proportion of inorganic material can also be used with other coating layers. The organic coating can be formed over a wholly inorganic coating comprising materials discussed above or can be used with a separate distinct organic coating as discussed above. When the container 10 is in place in the dispensing device 40, the coating or seal automatically dissolves upon being sprayed with water.

To manufacture the first embodiment of the container 10, a long paperboard blank is formed around a mandrel and heat sealed at the side seam. A plastic coating and any desired graphics have been applied prior to this forming process. The plastic coating applied to the inner and/or outer surface of the paperboard acts as the adhesive when activated by high temperature heaters. The circular disk 14 is placed in the tube 11 and sealed to the sidewalls 41 of the container 10. The bladder 21 is preferably made by a thermoforming process. A ring of hot-melt adhesive is applied to the bottom disk 14, and the bladder 21 is inserted within the housing 11 so as to adhere the bottom of the bladder 22 to the disk 14. The bladder's rim 34 is heat sealed to the rim 24 of the housing 11. The bladder 21 is then filled with the molten detergent, which is allowed to cool and solidify. The water soluble membrane or coating (not shown) is poured or sprayed onto the exposed surface of the detergent. The lid 12 is then snap-fit into place.

Figure 6:
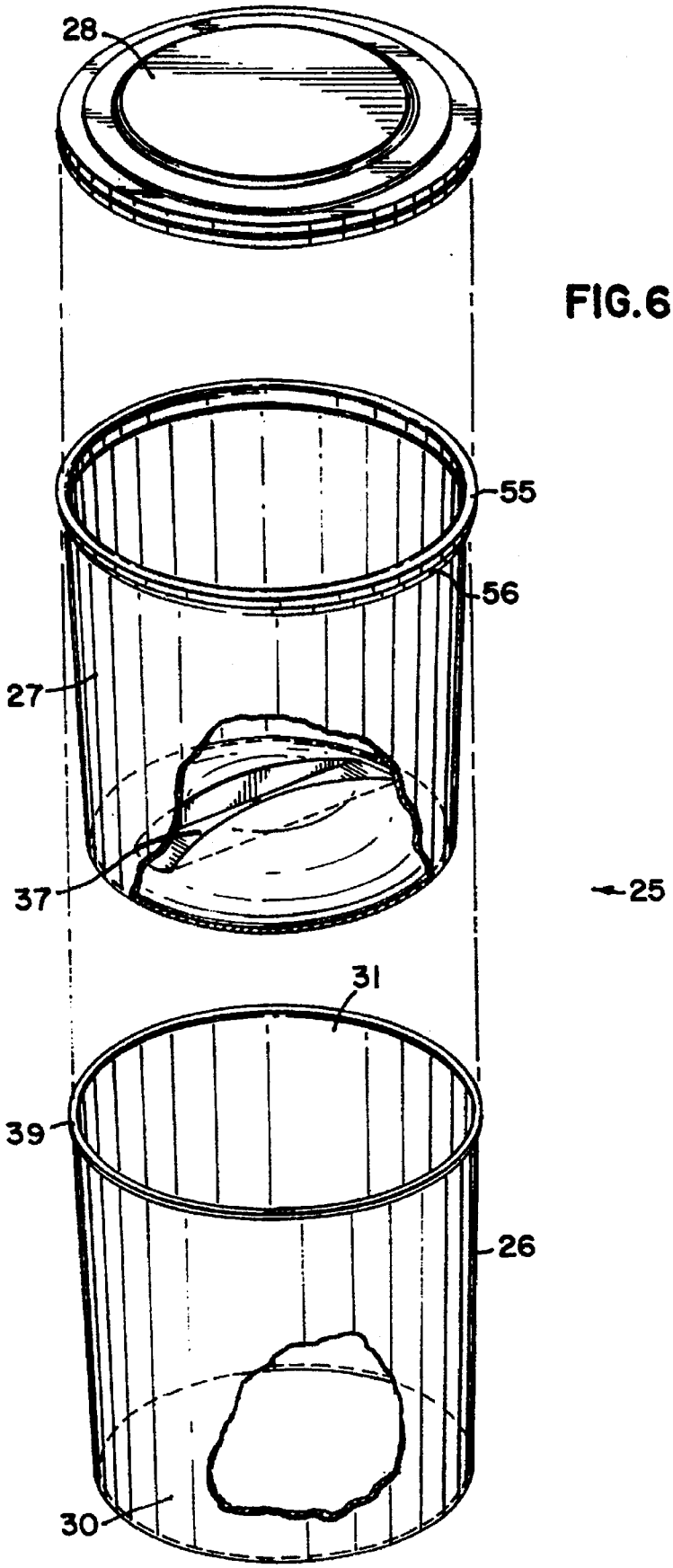
FIG. 6 is a exploded view of the container illustrated in FIGS. 4–5.

The second embodiment of the container is illustrated generally at 25 in FIGS. 4–6. This embodiment has a housing 26, a bladder 27, and a cap 32. The second embodiment 25 is also suitable for use with the dispensing device 40 as shown in FIG. 7. With each embodiment, the housing 11, 26 is approximately 6.5 inches (16.5 centimeters) in diameter and 5.5 inches (14.0 centimeters) in length. The bladder 27 is made of any suitable material that is capable of withstanding exposure to highly caustic detergent. The bladder 27 has a ring 56 to facilitate nesting.

With the design illustrated, the housing 26 is produced by a spiral winding method. A web of paperboard and a web of label are treated with adhesive and wound continuously on a reciprocating mandrel. The resulting tube is trimmed to the appropriate length according to the desired size of the housing 26. The seam lines 29 of the housing 26 are held in abutment by heat sealing.

Alternatively a convolute process may be used to form the housing 26, wherein the paperboard blank is coated with adhesive and entered onto a turning mandrel in a discontinuous process. The blank may be precut to the desired length before being entered onto the mandrel, or the cutting may be done after a long tube has been formed.

The tube or housing 26 has a first, open end 30, which remains open during use of the container; and a second, open end 31 which is covered with a removable cap 32. The cap 32 is similar to the cap 12 of the first embodiment. (There is no end member on the second embodiment of the container 25 which is similar to the disk 14 on the first embodiment of the container 10).

In the container's second embodiment, the bottom end 33 of the liner 27 may have a handle 37. Preferably, the handle 37 is integral with the bladder's body and molded as a single piece. The handle 37 is preferably formed as a longitudinal rib which extends outwardly from the end surface of the bladder 27. The user can position a thumb and finger(s) on each side of the rib in order to easily hold the container 25, and to insert and remove the container 25 from the dispenser housing 40.

Although the housings 11, 26 are illustrated as being cylindrical, they could have a rectangular, oval, or other shape, so long as the housing 11, 26 is able to fit securedly in the dispensing apparatus 40.

Although the first end 38, 31 of each container 10, 25 is shown as being completely open across its entire width, it is possible for the first end 38, 31 to have an annular end member with a central aperture (not shown). The annular end member could be flat or funnel-shaped. The aperture in the end member would permit passage of the water spray to the detergent's exposed face and the dispensing of the use solution.

To manufacture the second embodiment of the container 25, the paperboard is wrapped on a mandrel. The paperboard may be precut before being wrapped on the mandrel, or the cutting step may be performed at a later point. The tube edges are heat sealed to form the seam lines 29 of the housing. Any desired labels are applied to the tube. The label (not shown) may be made of coated papers, foil/kraft laminates and film constructions based on polyethylene or polypropylene. A label may also be applied to the raised surface 28 of the cap 32. The bladder 27 is preferably made by thermoforming process. A ring of hot-melt adhesive is applied to the rim 39 of the housing 26, and the bladder 27 is inserted within the housing 26 so that the bladder's lip 55 fits over the rim 39. (Alternatively, the lip 55 of the liner 27 may be heat-sealed to the rim 39 of the housing 26). The bladder 27 is then filled with the molten detergent which is allowed to cool and solidify. The water soluble membrane or coating is applied to the exposed surface of the detergent, and the lid 32 is snap-fit into place.

In operation of either of the embodiments 10, 25 of the container, the cap 12, 32 is removed, and the container 10, 25 is inverted and placed within the dispensing device 40. The operator uses the handle 17, 37 to lower the container 10, 25 into the dispensing device 40.

After the operator has lowered the lid 46 of the dispensing device 40 into position, then water enters the dispensing device 40 through the water inlet conduit 45. An upwardly-directed water spray dissolves the water-soluble coating which is on the exposed face of the detergent. The water spray also dissolves the exposed face of the solid detergent to form a use solution. When the detergent has been exhausted from the container 10, 25, the operator removes the empty container 10, 25 and replaces it in the dispensing device 40 with a full container. The operator can separate the bladder 21, 27 from the rest of the container 10, 25 by simply pulling the bladder 21, 27 out of the container 10, 25. The housing 11, 26 can then be disposed of in a suitable manner, while the bladder 25, 27 can be recycled.

While two preferred embodiments of the invention have been shown and described, it should be apparent that many modifications can be made without departing from the spirit and scope of the invention. Accordingly, the invention is not limited by the foregoing description, but is only limited by the scope of the claims.

What is claimed is:

1. A detergent-containing article, for insertion into a dispensing apparatus, said article comprising:

a) a semi-rigid bladder made of a plastic material;

b) a solid block chemical composition within said bladder, said chemical composition being a detergent composition for the washing of dishes, laundry, ware or hard surfaces, said bladder surrounding and in contact with the detergent composition on all but one surface thereof, said one surface being an eroding surface;

c) a housing surrounding said bladder, said housing having a first end which has an opening proximate said eroding surface of the detergent composition, said housing being made of a paperboard material having a waterproof coating, said housing having a substantially uniform cross-section and being sized and configured to fit within a dispensing apparatus;

d) a cap which is removably attached to said first end of said housing.

2. The article of claim 1, wherein said bladder is made of a recyclable plastic material.

3. The article of claim 2, wherein said bladder has a first end proximate said eroding surface and on opposite second end, said bladder including an integral handle in said second end of said bladder.

4. The article of claim 2, further comprising a water-soluble coating on the eroding surface of the detergent.

5. The article of claim 4, wherein said water-soluble coating comprises polyvinylalcohol.

6. The article of claim 3, wherein said bladder has a ring proximate said first end.

7. The article of claim 6, wherein a first bladder is sized and configured to fit in a nesting relationship with a second bladder when said first and second bladders are empty.

8. The article of claim 1, wherein said housing includes an end wall at a second end opposite said first end, said end wall including a handle.

9. The article of claim 8, wherein said end wall includes a wet strength additive.

10. The article of claim 8, wherein said handle is formed from a cutout portion in said end wall.

11. The article of claim 10, wherein said handle comprises a pair of symmetrical apertures in said end wall.

12. A detergent-containing article for insertion into a dispensing apparatus, said article comprising:

a) a semi-rigid bladder made of a plastic material, said bladder having an opening surrounded by a lip;

b) a solid block chemical composition within said bladder, said chemical composition being a detergent composition for the washing of dishes, laundry, ware or hard surfaces, said bladder surrounding and in contact with the detergent composition on all but one surface thereof, said one surface being an eroding surface, said bladder including an end surface opposite said eroding surface, said end surface including handle means, said eroding surface having a water-soluble coating thereon; and c) a substantially cylindrical housing surrounding said bladder, said housing having a rim which fits within said lip of said bladder, wherein said bladder can be separated from said housing after said article of commerce has been used, said housing being made of a paperboard material having a waterproof coating, said housing being sized and configured to fit within a dispensing apparatus.

13. The article of claim 12, wherein said bladder is made of a recyclable plastic material.

14. The article of claim 12, wherein said handle means comprises a rib extending across said end surface of said bladder.

15. The article of claim 12, wherein said housing is made of a paperboard material formed from a convolute manufacturing process.

16. The article of claim 12, wherein said housing is made of a paperboard material formed from a spiral winding manufacturing process.

17. The article of claim 12, wherein said water-soluble coating comprises polyvinylalcohol.

18. The article of claim 12, wherein said bladder has a ring proximate said eroding surface of said chemical.

19. The article of claim 12, wherein a first bladder is sized and configured to fit in a nesting relationship with a second bladder when said first and second bladders are empty.

20. The article of claim 12, wherein at least a portion of said housing includes a wet strength additive.

21. The article of claim 12, wherein said housing includes an end wall, said end wall having a pair of symmetrical apertures.

22. The article of claim 12, wherein said bladder includes integral handle means.

23. A detergent dispensing system, comprising:

a) a dispensing apparatus having a first size and configuration;

b) a detergent-containing article, said article including:

i) a semi-rigid bladder made of a plastic material;

ii) a solid block chemical composition within said bladder, said chemical composition being a detergent composition for the washing of dishes, laundry, ware or hard surfaces, said bladder surrounding and in contact with the detergent composition on all but one surface thereof, said one surface being an eroding surface;

iii) a paperboard housing attached to said bladder, said housing having a second size and configuration which is adapted to fit within said dispensing apparatus, said housing having an opening proximate said eroding surface of the detergent composition, at least a portion of said housing having moisture resistant means; and iv) a cap which is removably attached to said first end of said housing.

* * * * *

UNITED STATES PATENT AND TRADEMARK OFFICE

CERTIFICATE OF CORRECTION

PATENT NO. : 5,627,150

DATED : May 6, 1997

INVENTOR(S) : Jeff W. Peterson et al.

It is certified that error appears in the above-identified patent and that said Letters Patent is hereby corrected as shown below:

On column 2, lines 23-29, please delete lines 23-29.

On column 3, line 23, please delete "a" and substitute therefore --an--

On column 6, line 18, please insert --,-- after "amine"

On column 7, line 63, please insert --a-- after "by"

On column 8, line 53 (claim 3), please delete "on" and substitute therefore --an--

Signed and Sealed this

Eighteenth Day of November 1997

*Attest:*

*Attesting Officer*

Bruce Lehman

BRUCE LEHMAN

*Commissioner of Patents and Trademarks*